US009531133B1

(12) United States Patent
Horning et al.

(10) Patent No.: US 9,531,133 B1
(45) Date of Patent: Dec. 27, 2016

(54) ELECTRICAL CONNECTOR HAVING LOSSY SPACERS

(71) Applicant: TYCO ELECTRONICS CORPORATION, Berwyn, PA (US)

(72) Inventors: Michael James Horning, Lancaster, PA (US); Chad William Morgan, Carneys Point, NJ (US); Leo Joseph Graham, Hershey, PA (US); Bruce Allen Champion, Camp Hill, PA (US); David W. Heister, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/967,836

(22) Filed: Dec. 14, 2015

(51) Int. Cl.

| | |
|---|---|
| ***H01R 12/00*** | (2006.01) |
| ***H01R 13/6585*** | (2011.01) |
| ***H01R 12/71*** | (2011.01) |
| ***H01R 13/6471*** | (2011.01) |

(52) U.S. Cl.
CPC ..... *H01R 13/6585* (2013.01); *H01R 12/716* (2013.01); *H01R 13/6471* (2013.01)

(58) Field of Classification Search
CPC ..... H01R 12/52; H01R 12/716; H01R 9/096
USPC ..... 439/74, 108
See application file for complete search history.

(56) References Cited

U.S. PATENT DOCUMENTS

| | | | | |
|---|---|---|---|---|
| 7,371,117 | B2 * | 5/2008 | Gailus | H01R 13/719 439/607.08 |
| 8,083,553 | B2 | 12/2011 | Manter et al. | |
| 8,177,564 | B1 | 5/2012 | Ito et al. | |
| 8,485,831 | B2 * | 7/2013 | Cipolla | H01R 13/514 439/607.07 |
| 8,523,583 | B2 | 9/2013 | Ito | |
| 9,028,281 | B2 * | 5/2015 | Kirk | H01R 12/724 439/701 |
| 9,219,335 | B2 * | 12/2015 | Atkinson | H01R 13/658 |
| 2014/0127946 | A1 | 5/2014 | Ito et al. | |
| 2015/0056856 | A1 | 2/2015 | Atkinson et al. | |

OTHER PUBLICATIONS

Zhang, Li and Zhuan; Energy-efficient operation of Heavy Haul Trains in an MPC Framework; IEEE; 6 pages.

* cited by examiner

*Primary Examiner* — Phuong Dinh

(57) ABSTRACT

An electrical connector includes a housing stack having a first housing and a second housing stacked together with the first housing. The housing stack defines a mating end and a mounting end opposite the mating end. The housing stack defines signal contact cavities and ground contact cavities that extend continuously through the housings. At least one of the first housing and the second housing has pockets around the ground contact cavities with lossy spacers disposed therein each having a groove aligned with the corresponding ground contact cavity. Signal contacts are disposed in corresponding signal contact cavities. Ground contacts are disposed in corresponding ground contact cavities. The ground contacts are disposed in the grooves of the corresponding lossy spacers such that the ground contacts are coupled to the corresponding lossy spacers.

20 Claims, 3 Drawing Sheets

ELECTRICAL CONNECTOR HAVING LOSSY SPACERS

BACKGROUND OF THE INVENTION

The subject matter herein relates generally to electrical connectors that have an array of signal and ground contacts.

Some electrical connector systems utilize electrical connectors, such as mezzanine connectors, to interconnect two circuit boards, such as a motherboard and daughter card. The conductors of one electrical connector are terminated to one circuit board and extend through the housing towards a mating end to engage mating conductors of the mating connector terminated to the other circuit board.

Some known electrical connectors have electrical problems, particularly when transmitting at high data rates. For example, the electrical connectors typically utilize differential pair signal conductors to transfer high speed signals. Ground conductors improve signal integrity. However, electrical performance of known electrical connectors, when transmitting the high data rates, is inhibited by resonance spikes, such as at high frequencies.

A need remains for a high density, high speed electrical connector assembly having reliable performance.

BRIEF DESCRIPTION OF THE INVENTION

In an embodiment, an electrical connector is provided including a housing stack having a first housing and a second housing stacked together with the first housing. The housing stack defines a mating end configured for mating with a mating connector and a mounting end configured for mounting to a circuit board. The mounting end is opposite the mating end. The second housing is disposed rearward of the first housing. The housing stack defines signal contact cavities and ground contact cavities that extend continuously through the first housing and the second housing between the mating end and the mounting end. At least one of the first housing and the second housing has pockets around the ground contact cavities. Lossy spacers are disposed in corresponding pockets. The lossy spacers each have a groove aligned with the corresponding ground contact cavity. Signal contacts are disposed in corresponding signal contact cavities of the housing stack and are provided at or near the mating and mounting ends for electrical connection to the mating connector and the circuit board, respectively. Ground contacts are disposed in corresponding ground contact cavities of the housing stack and are provided at or near the mating and mounting ends for electrical connection to the mating connector and the circuit board, respectively. The ground contacts are disposed in the grooves of the corresponding lossy spacers such that the ground contacts are coupled to the corresponding lossy spacers.

In another embodiment, an electrical connector is provided including a housing stack having a first housing and a second housing stacked together with the first housing. The housing stack defines a mating end configured for mating with a mating connector and a mounting end configured for mounting to a circuit board. The mounting end is opposite the mating end. The second housing is disposed rearward of the first housing. The housing stack defines signal contact cavities and ground contact cavities that extend axially through the first housing and the second housing between the mating end and the mounting end. At least one of the first housing and the second housing has pockets around the ground contact cavities. Lossy spacers are disposed in corresponding pockets. The lossy spacers each have a groove aligned with the corresponding ground contact cavity. The lossy spacers are separated from each other by gaps. Signal contacts and ground contacts are disposed in corresponding signal and ground contact cavities of the housing stack and are provided at or near the mating and mounting ends for electrical connection to the mating connector and the circuit board, respectively. The ground contacts are disposed in the grooves of the corresponding lossy spacers such that the ground contacts are coupled to the corresponding lossy spacers. The signal contacts are arranged in signal rows along signal row axes and the ground contacts are arranged in ground rows along ground row axes.

In a further embodiment, an electrical connector is provided including a housing stack having a first housing and a second housing stacked together with the first housing. The housing stack defines a mating end configured for mating with a mating connector and a mounting end configured for mounting to a circuit board. The mounting end is opposite the mating end. The second housing is disposed rearward of the first housing. The housing stack has opposite first and second sides and opposite first and second ends extending between the mating and mounting ends. The housing stack defines signal contact cavities and ground contact cavities that extend axially through the first housing and the second housing between the mating end and the mounting end. At least one of the first housing and the second housing has pockets around the ground contact cavities. Lossy spacers are disposed in corresponding pockets. Each lossy spacer has a front and a rear rearward of the front. Each lossy spacer has opposite first and second sides and opposite first and second ends. Each lossy spacer has a groove open at the first side. The lossy spacers are arranged in an array in rows and columns. The ends of the lossy spacers in the rows are separated by gaps. The sides of the lossy spacers in the columns are separated by gaps. Signal contacts are disposed in corresponding contact cavities of the housing stack and are provided at or near the mating and mounting ends for electrical connection to the mating connector and circuit board, respectively. The signal contacts are aligned in-column with the columns of lossy spacers and are positioned in the gaps therebetween such that the signal contacts do not directly engage the lossy spacer. Ground contacts are disposed in corresponding ground contact cavities of the housing stack and are provided at or near the mating and mounting ends for electrical connection to the mating connector and the circuit board, respectively. The ground contacts are disposed in the grooves of the corresponding lossy spacers such that the ground contacts are coupled to the corresponding lossy spacers.

DETAILED DESCRIPTION OF THE INVENTION

Figure 1:
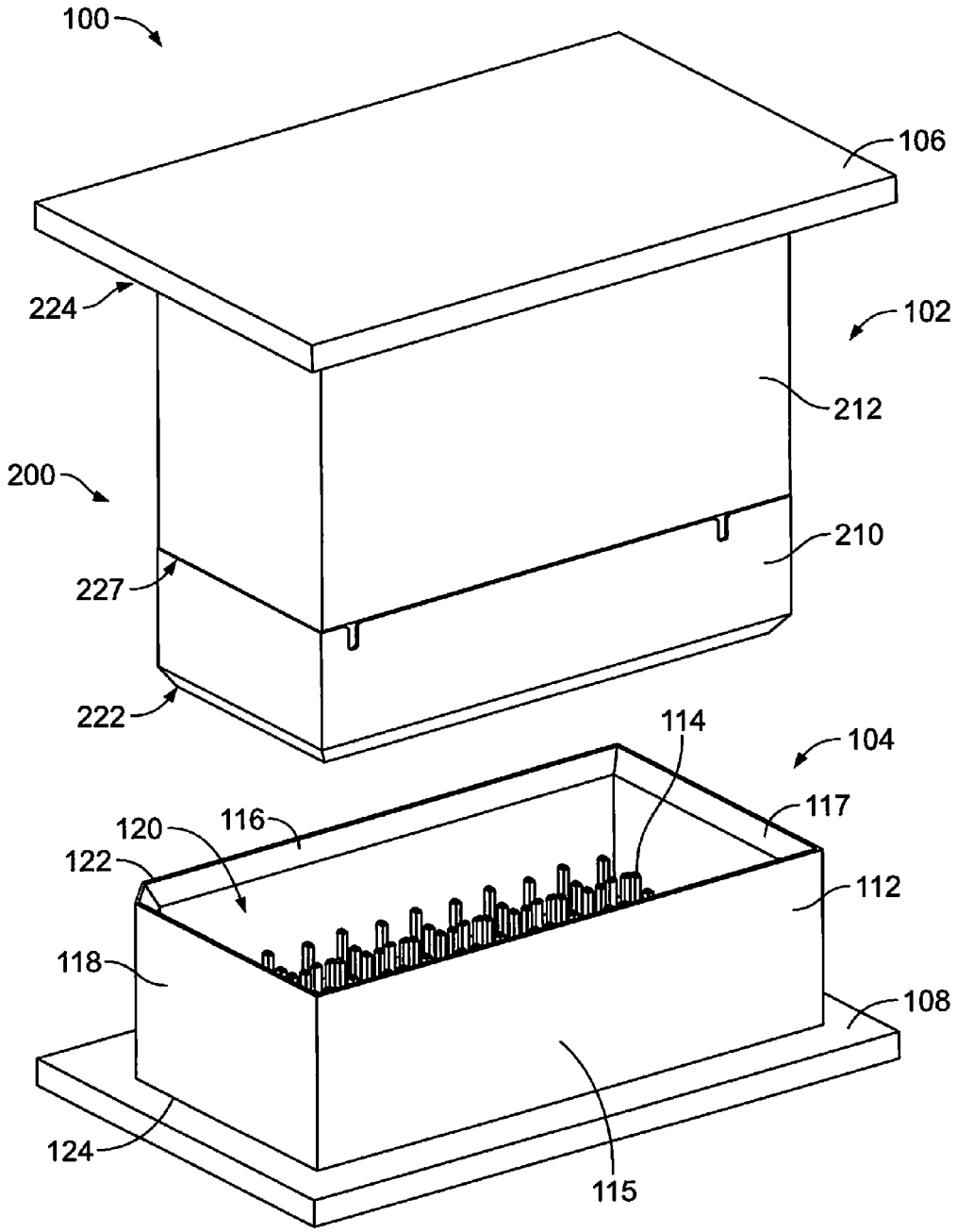
FIG. 1 is a top perspective view of an electrical connector system formed in accordance with an embodiment.

FIG. 1 is a top perspective view of an electrical connector system 100 formed in accordance with an embodiment. The electrical connector system 100 includes a first electrical connector 102 and a second electrical connector 104 that are configured to be directly mated together. The electrical connector system 100 may be disposed on or in an electrical component, such as a server, a computer, a router, or the like. In FIG. 1, the first electrical connector 102 and the second electrical connector 104 are shown un-mated, but poised for mating to one another.

In an exemplary embodiment, the first electrical connector 102 is a receptacle connector, and the second electrical connector 104 is a header connector. The electrical connectors 102, 104 are mating halves of a mezzanine connector; however the subject matter described herein is not intended to be limited to mezzanine connectors but rather may have application to other types of connectors in alternative embodiments, such as right angle connectors or other types of connectors.

The first electrical connector 102 and the second electrical connector 104 are configured to be electrically connected to respective first and second circuit boards 106, 108. The first and second electrical connectors 102, 104 are utilized to provide a signal transmission path to electrically connect the circuit boards 106, 108 to one another at a separable mating interface. In FIG. 1, the first electrical connector 102 is mounted to the first circuit board 106, and the second electrical connector 104 is mounted to the second circuit board 108. In an embodiment, the first and second circuit boards 106, 108 are oriented parallel to one another when the first and second electrical connectors 102, 104 are mated. As such, the electrical connector system defines a mezzanine connector system with the electrical connectors 102, 104 arranged between the parallel circuit boards 106, 108. The signal paths or electrical paths through the electrical connectors pass linearly or axially between the circuit boards 106, 108. Optionally, the connectors 102, 104 may have variable heights to provide a desired distance (or fit) between the parallel circuit boards 106, 108. For example, the receptacle connector 102 may have a variable height (for example, a family of different heights), such as by varying the length of the contacts and the height of the housing to control the positioning of the circuit board 106 relative to the circuit board 108. Alternative relative orientations of the circuit boards 106, 108, such as a perpendicular orientation, are possible in other embodiments. In an alternative embodiment, the first electrical connector 102 and/or the second electrical connector 104 may be terminated to one or more cables rather than being board mounted.

In the illustrated embodiment, the header connector 104 includes a header housing 112 and a plurality of header contacts 114. The header housing 112 extends between a mating end 122 and a mounting end 124. The header housing 112 includes multiple outer walls that define a chamber 120 therebetween. For example, the header housing 112 may include opposite sides 115, 116 and opposite ends 117, 118; however the header housing 112 may have other walls defining other shaped housings. Optionally, the sides 115, 116 are longer than the ends 117, 118 and thus the sides 115, 116 extend in a longitudinal direction and the ends 117, 118 extend in a lateral direction.

The chamber 120 is open at the mating end 122 of the header housing 112 and is configured to receive a portion of the receptacle connector 102 therein. All or at least some of the outer walls may be beveled at the mating end 122 to provide a lead-in section to guide the receptacle connector 102 into the chamber 120 during mating. In the illustrated embodiment, the header housing 112 has a fixed height between the mating end 122 and the mounting end 124. The header housing 112 may be formed of at least one dielectric material, such as a plastic or one or more other polymers. A base wall (not shown) is provided at or near the mounting end 124 that closes the bottom of the chamber 120. The mounting end 124 of the header housing 112 faces, and may also engage, a surface of the second circuit board 108.

The header contacts 114 may define signal contacts and ground contacts arranged in an array, such as along rows and columns in the chamber 120. Optionally, the ground contacts may be longer than the signal contacts to form a sequenced mating interface for mating with the receptacle connector 102. The contacts 114 are formed of a conductive material, such as copper, a copper alloy, and/or another metal or metal alloy. In the illustrated embodiment, the contacts 114 include flat blades at mating ends thereof that are disposed in the chamber 120; however the contacts 114 may have other mating interfaces in alternative embodiments, such as spring beams, sockets, pins, and the like. The contacts 114 also include terminating segments (not shown) that are configured to engage and electrically connect to a corresponding conductor (not shown) of the circuit board 108. The conductors of the circuit board 108 may be electric pads or traces, plated vias, or the like. In various embodiments, the terminating segments of the contacts 114 are compliant pins, such as eye-of-the-needle pins, which are received in plated vias of the circuit board 108.

The receptacle connector 102 includes a housing 200 that extends between a mating end 222 and a mounting end 224. Optionally, the housing 200 is modular and includes multiple pieces being stacked together as a housing stack, which may be referred to hereinafter as a housing stack 200. Alternatively, the housing 200 may be a single piece body. Optionally, the housing stack 200 includes at least a first housing 210 and a second housing 212, which are stackable units; however the housing stack may include additional housings such as between, forward of or rearward of the first and second housings 210, 212. In the illustrated embodiment, the first housing 210 is provided at a front of the housing stack 200 and is thus referred to hereinafter as a front housing 210 while the second housing 212 is provided at a rear of the housing stack 200 and is thus referred to hereinafter as a rear housing 212. However, it is realized that the housing stack 200 may include middle housings (not shown) between the front and rear housings 210, 212. In other embodiments, the second housing 212 may be a middle housing and one or more housings may be provided rearward of the second housing 212 to define the rear housing. Having multiple housings stacked together allows for additional stack height. Having multiple housings allows positioning of lossy material at various heights/positions along the contacts.

The rear housing 212 is positioned or located rearward of the front housing 210. The front and rear housings 210, 212 are manufactured from a low loss dielectric material, such as a plastic material. The low loss dielectric material has dielectric properties that have relatively little variation with frequency. The receptacle connector 102 holds a plurality of contacts 214 (shown in FIG. 2), which may include both signal contacts and ground contacts. The contacts 214 extend through the front and rear housings 210, 212 and are provided at or near both the mating end 222 and the mounting end 224 for termination to the header connector 104 and circuit board 106, respectively.

Optionally, the rear housing 212 may be replaceable with one of many different rear housings 212, such as rear housings 212 having different heights, that are matable to the same front housing 210 to change the stack height of the housing stack 200. A particular rear housing 212 is selected to provide a particular size or height receptacle connector 102 depending on the particular application and/or spacing needed between the circuit boards 106, 108. A shorter or taller rear housing may be selected to decrease or increase the height of the receptacle connector 102 in other embodiments.

In an exemplary embodiment, the receptacle connector 102 includes lossy spacers 202 (shown in FIG. 2) within the rear housing 212 and/or the front housing 210. The lossy spacers 202 may be located at any location along the housings 212 and/or 210. In an exemplary embodiment, the lossy spacers 202 are provided at the interface between the front housing 210 and the rear housing 212. The lossy spacers 202 are manufactured from lossy material configured to absorb at least some electrical resonance that propagates along the current path defined by the signal contacts and/or the ground contacts through the receptacle connector 102 between the mating and mounting ends 222, 224. The lossy material provides lossy conductivity and/or magnetic lossiness through a portion of the receptacle connector 102. The lossy material has dielectric properties that vary with frequency. The lossy material has a loss tangent that is greater or higher than a loss tangent of the low loss dielectric material of the housings 210, 212.

The lossy material is able to conduct electrical energy, but with at least some loss. The lossy material is less conductive than the conductive material of the contacts 214. The lossy material may be designed to provide electrical loss in a certain, targeted frequency range. The lossy material may include conductive particles (or fillers) dispersed within a dielectric (binder) material. The dielectric material, such as a polymer or epoxy, is used as a binder to hold the conductive particle filler elements in place. These conductive particles then impart loss to the lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% or more by volume. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles.

As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connectors. The thermoplastic material may facilitate the molding of the lossy spacer 202 into the desired shape and/or location. However, many alternative forms of binder materials may be used. Curable materials, such as epoxies, can serve as a binder. Alternatively, materials such as thermosetting resins or adhesives may be used.

As used herein, relative or spatial terms such as "top," "bottom," "front," "rear," "left,", "right", "horizontal", and "vertical" are only used to distinguish the referenced elements and do not necessarily require particular positions or orientations in the electrical connector system 100 or in the surrounding environment of the electrical connector system 100.

Figure 2:
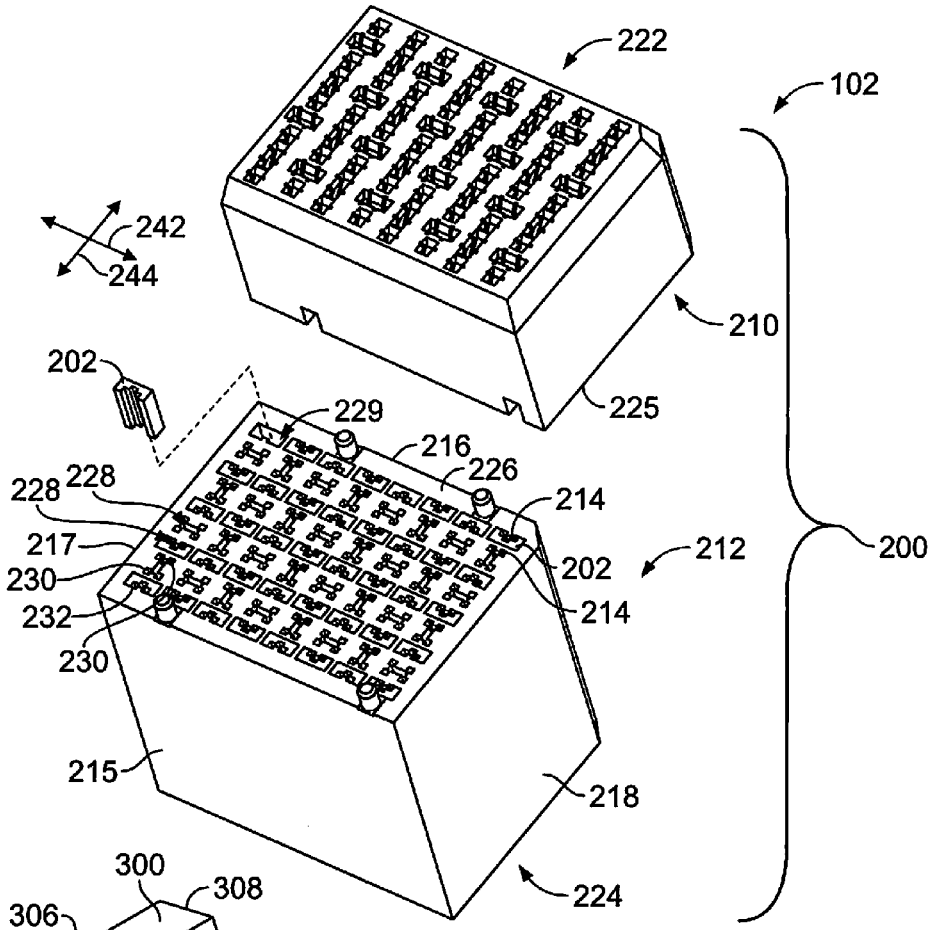
FIG. 2 is an exploded perspective view of an electrical connector of the electrical connector system in accordance with an exemplary embodiment.

FIG. 2 is an exploded perspective view of the receptacle connector 102 in accordance with an exemplary embodiment. The housing stack 200 includes multiple outer walls that extend between the mating and mounting ends 222, 224. For example, the housing stack 200 may include opposite sides 215, 216 and opposite ends 217, 218 (for example, both the front housing 210 and the rear housing 212 include sides 215, 216 and ends 217, 218); however the housing stack 200 may have other walls defining other shaped housings. Optionally, the sides 215, 216 are longer than the ends 217, 218 and thus the sides 215, 216 extend in a longitudinal direction 242 and the ends 217, 218 extend in a lateral direction 244.

The lossy spacers 202 (also shown in FIG. 3) are provided at the interface between the front housing 210 and the rear housing 212. For example, the front and rear housings 210, 212 both include inner ends 225, 226 facing each other at a seam 227 (shown in FIG. 1) between the front and rear housings 210, 212. The front and rear housings 210, 212 are coupled together at the seam 227. The lossy spacers 202 are arranged at the seam 227. Optionally, the lossy spacers 202 may be received in pockets 229 formed in the rear housing 212 at the inner end 226. Additionally, or alternatively, the lossy spacers 202 may be received in pockets (not shown) formed in the front housing 210 at the inner end 225.

In an exemplary embodiment, the lossy spacers 202 are molded in situ in the pockets 229. The rear housing 212 (and/or the front housing 210) may be manufactured by a multi-stage molding process. For example, the main body of the rear housing 212 may be manufactured during an initial molding or first stage using low-loss dielectric material where the pockets 229 are formed and the lossy spacers 202 may then be molded during a second stage using lossy material. Alternatively, the lossy spacers 202 may be molded separate from the rear housing 212 and inserted into the pockets 229 formed in the rear housing 212. Optionally, multiple lossy spacers 202 may be molded together and attached by a carrier strip. The lossy spacers 202, on the carrier strip, may be inserted as a unit into the rear housing 212 and then the carrier strip can be removed.

The housing stack 200 includes contact cavities 228 extending through the front housing 210 and the rear housing 212 that receive corresponding receptacle contacts 214 (shown in cross-section in FIG. 2). The receptacle contacts 214 may include both signal contacts and ground contacts, which are identified by reference numbers 230 and 232, respectively. Optionally, the signal contacts 230 and ground contacts 232 may be similar or identical in various embodiments. The layout or pattern of signal and ground contacts 230, 232 is complementary to the layout or pattern of the header contacts 114 for mating. The contacts 214 are arranged in an array, such as along rows and columns, within the housing stack 200. The contacts 214 may be arranged in any number of rows and columns. For example, in the illustrated embodiment, the receptacle connector 102 includes nine rows and eight columns of contacts 214. The contact cavities 228 are arranged to accommodate and receive the rows and columns of contacts 214 (for example, the contact cavities 228 are arranged in rows and columns). The layout or pattern of contact cavities 228 is complementary to the layout or pattern of the header contacts 114 for receiving the header contacts 114 during mating of the receptacle connector 102 with the header connector 104.

Figure 3:
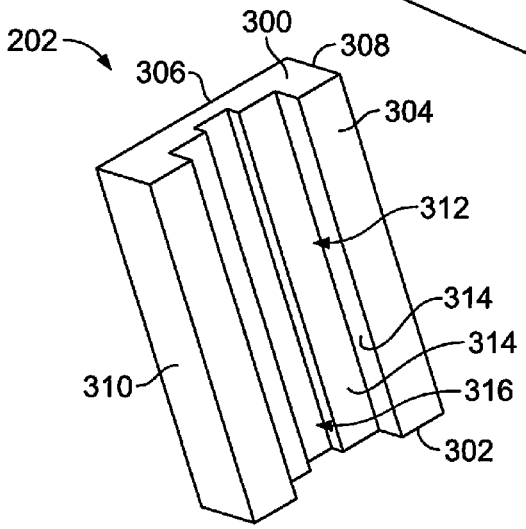
FIG. 3 is a front perspective view of a lossy spacer for the electrical connector shown in FIG. 2 in accordance with an exemplary embodiment.

FIG. 3 is a front perspective view of one of the lossy spacers 202 in accordance with an exemplary embodiment. The lossy spacer 202 is manufactured from a lossy material providing lossy conductivity and/or magnetic lossiness. The lossy spacer 202 may have any shape and/or length to interact with the ground contacts 232 (shown in FIG. 2). The material and the shape/length of the lossy spacer 202 may be selected to affect the absorbing properties of the lossy spacer 202 and provide electrical loss in a certain, targeted frequency range.

The lossy spacer 202 includes a front 300 and a rear 302 opposite the front 300. The lossy spacer 202 extends axially between the front 300 and the rear 302. The lossy spacer 202 includes opposed first and second sides 304, 306 and opposed first and second ends 308, 310 between the front 300 and the rear 302. The sides 304, 306 are wider than the ends 308, 310. The lossy spacer 202 may include other walls or surfaces in alternative embodiments to have a different shape.

The lossy spacer 202 includes a groove 312 extending therethrough from the rear 302 to the front 300. The groove 312 is configured to receive the corresponding ground contact 232. The groove 312 is sized and shaped to receive the ground contact 232. In the illustrated embodiment, the groove 312 is open at the first side 304. However, in alternative embodiments, the groove 312 may be open at the second side 306 or may be closed on all sides and completely surrounded by the lossy material of the lossy spacer 202. The groove 312 has groove walls 314 defining interior surfaces of the groove 312. The groove 312 may have any shape and any number of interior surfaces.

Optionally, the lossy spacer 202 may include a channel 316 open to the groove 312. The channel 316 may define an air space along the ground contact 214, such as to control electrical properties of the ground contact 214. Optionally, a portion of the ground contact 214 may extend into or pass through the channel 316, such as during loading of the ground contact 214 into the lossy spacer 202.

Figure 4:
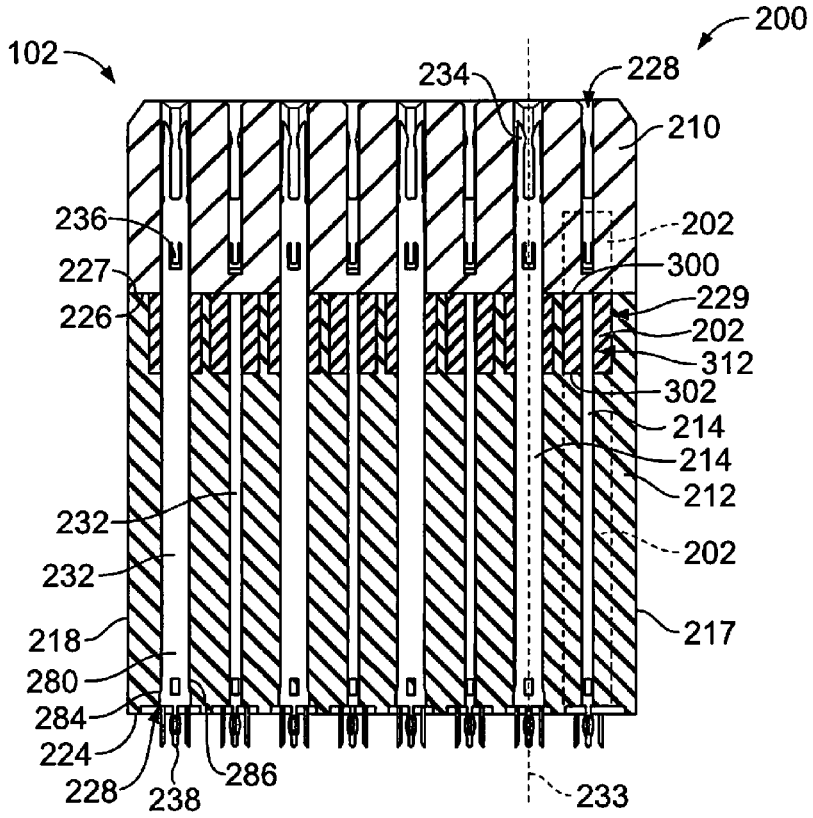
FIG. 4 is a cross-sectional view of the electrical connector shown in FIG. 2.
Figure 5:
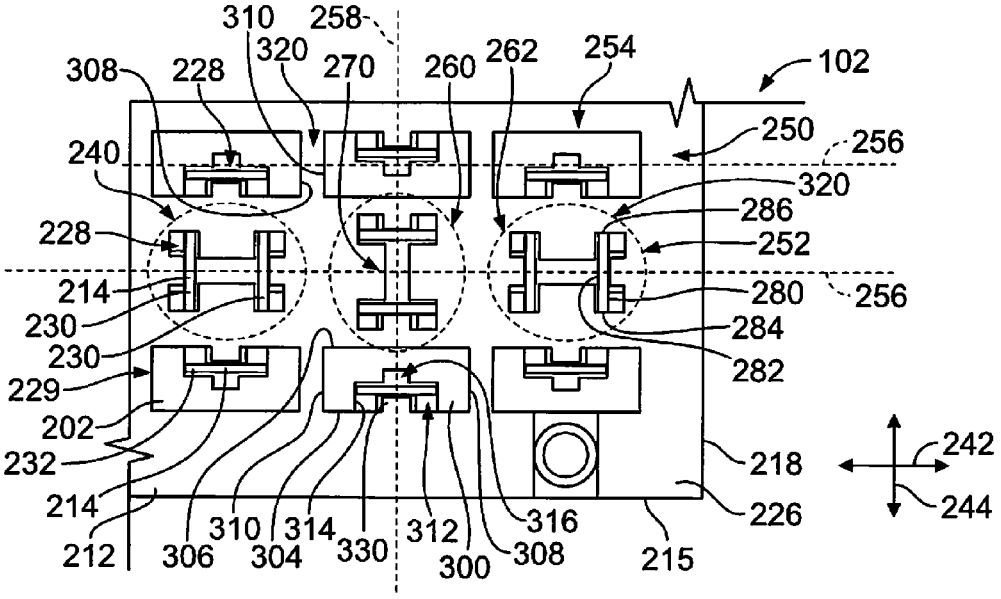
FIG. 5 is an end view of a portion of the electrical connector shown in FIG. 2.

FIG. 4 is a cross-sectional view of the receptacle connector 102. FIG. 5 is an end view of a portion of the receptacle connector 102. FIGS. 4 and 5 illustrate the signal and ground contacts 230, 232 arranged in rows and columns, which correspond to the rows and columns of the contact cavities 228. FIGS. 4 and 5 illustrate an exemplary arrangement of the lossy spacers 202 within the housing stack 200, showing the lossy spacers 202 associated with corresponding ground contacts 232. The grooves 312 of the lossy spacers 202 are aligned with the contact cavities 228 to receive the ground contacts 232. The grooves 312 may define portions of the contact cavities 228.

The receptacle contacts 214 extend along contact axes 233 between mating ends 234 and terminating ends 238. The contact axes 233 may extend parallel to the sides 217, 218. The receptacle contacts 214 extend through the array of lossy spacers 202 (for example, the mating ends 234 are located forward of the lossy spacers 202 and the terminating ends 238 are located rearward of the lossy spacers 202). In an exemplary embodiment, the signal contacts 230 do not extend through the lossy spacers 202 such that the signal contacts 230 do not directly engage the lossy material of the lossy spacers 202.

Each ground contact 232 extends through a corresponding lossy spacer 202 such that the ground contacts 232 are coupled by the lossy spacers 202. For example, the ground contacts 232 are received in corresponding grooves 312. Optionally, the ground contacts 232 may directly engage the lossy spacer 202. In an exemplary embodiment, the ground contacts 232 may include protrusions aligned with the lossy spacers 202 that engage the lossy spacers 202. The protrusions may define interference bumps that force the ground contacts 232 to press against the lossy spacers 202. In other embodiments, the ground contacts 232 are coupled to the lossy spacers 202 by being closely coupled to the lossy spacers 202 rather than being directly coupled thereto, such close coupling providing lossy conductivity along portions of the ground contacts 232.

The receptacle contacts 214 are formed of a conductive material, such as copper, a copper alloy, and/or another metal or metal alloy. In the illustrated embodiment, the contacts 214 include sockets at the mating ends 234 thereof for receiving the blades of the header contacts 114; however the contacts 214 may have other mating interfaces in alternative embodiments, such as spring beams, pins, and the like. The terminating ends 238 are configured to engage and electrically connect to a corresponding conductor (not shown) of the circuit board 106 (shown in FIG. 1). In various embodiments, the terminating ends 238 of the contacts 214 are compliant pins, such as eye-of-the-needle pins, which are received in plated vias of the circuit board 106.

Each receptacle contact 214 includes opposite broad sides 280, 282 and opposite edge sides 284, 286 narrower than the broad sides 280, 282. In an exemplary embodiment, the receptacle contacts 214 are manufactured by stamping and forming the receptacle contacts 214. For example, the receptacle contacts 214 may be stamped from a blank or sheet of stock metal material. The edge sides 284, 286 are defined by the sheared or cut edges during the stamping process. The broad sides 280, 282 are defined by the planar surfaces of the sheet of stock material. Optionally, the receptacle contacts 214 may include retention lances or latches 236 (FIG. 4) used to hold the receptacle contacts 214 in the contact cavities 228. The retention latches 236 extend from the broad sides 280, 282. The retention latches 236 are captured against corresponding latching surfaces in the housings 210, 212 to hold the receptacle contacts 214 in the contact cavities 228.

In an exemplary embodiment, the signal contacts 230 may be arranged in signal pairs 240 (FIG. 5) configured to convey differential signals. Select signal pairs 240 may be separated from each other by corresponding ground contacts 232. For example, the ground contacts 232 may flank opposite sides of the signal pairs 240. The ground contacts 232 provide electrical shielding between adjacent signal pairs 240.

The receptacle contacts 214 have a predetermined layout for termination to the circuit board 106 (shown in FIG. 1) and for mating with the header connector 104 (shown in FIG. 1). In an exemplary embodiment, the receptacle contacts 214 are arranged in an array in rows 250, 252 and columns 254 (all shown in FIG. 5). In an exemplary embodiment, both signal contacts 230 and ground contacts 232 are interspersed with each other in each of the columns 254. The rows 250 define ground rows, which may be referred to hereinafter as ground rows 250, and include only ground contacts 232. The rows 252 are signal rows, which may be referred to as signal rows 252, and include only signal contacts 230. In other various embodiments, the rows 250 and/or 252 may include both signal and ground contacts 230, 232. In an exemplary embodiment, the array of receptacle contacts 214 includes alternating ground and signal rows.

The rows 250, 252 extend along row axes 256 (FIG. 5) and the columns 254 extend along column axes 258 (FIG. 5). The row axes 256 extend longitudinally, such as in the longitudinal direction 242, and the column axes 258 extend laterally, such as in the lateral direction 244. The row axes 256 extend generally parallel to the sides 215, 216 while the column axes 258 extend generally parallel to the ends 217, 218. FIG. 4 is a cross-section taken along one of the ground rows 250 showing that the ground contacts 232 are staggered.

As noted above, in an exemplary embodiment, the signal contacts 230 are arranged in pairs 240 in the columns 254 and are arranged in pairs 240 in the signal rows 252. The pairs 240 of signal contacts 230 have alternating horizontal and vertical orientations. For example, within the columns 254, adjacent pairs 240 have alternating horizontal and vertical orientations and, within the signal rows 252, the pairs 240 have alternating horizontal and vertical orientations.

In an exemplary embodiment, each pair 240 of signal contacts 230 defines either a column pair, which is referred to hereinafter as column pair 260 (FIG. 5), or a cross pair, which is referred to hereinafter as cross pair 262 (FIG. 5). The signal contacts 230 of each column pair 260 are arranged in-column along a corresponding column axis 258. The signal contacts 230 of each cross pair 262 are arranged across the corresponding column axis 258. For example, the signal contacts 230 within each cross pair 262 flank opposite sides of the corresponding column axis 258 in close proximity to the column axis 258. While neither signal contact 230 of the cross pair 262 lies directly on the column axis 258 (which splits the pair of signal contacts 230), the pair of signal contacts 230 of the cross pair 262 are considered to be part of the respective column 254 as such signal contacts 230 are both in close proximity to the column axis 258 and associated with the column 254. The field defined between the signal contacts 230 of the cross pair 262 lies across the column axis 258. Similarly, the signal contacts 230 within each column pair 260 flank opposite sides of the corresponding row axis 256 in close proximity to the row axis 256. While neither signal contact 230 of the column pair 260 lies directly on the row axis 256 (which splits the pair of signal contacts 230), the pair of signal contacts 230 of the column pair 260 are considered to be part of the respective signal row 252 as such signal contacts 230 are both in close proximity to the row axis 256 and associated with the signal row 252.

Optionally, the ground contacts 232 in the ground rows 250 may be staggered along the row axes 256. For example, some of the ground contacts 232 may be shifted to one side of the corresponding row axis 256 while other ground contacts 232 may be shifted to the other side of the corresponding row axis 256. The ground contacts 232 are staggered to accommodate and provide space for the column pairs 260. The lossy spacers 202 are arranged to accommodate the staggered ground contacts 232. For example, the grooves 312 may be staggered along each of the row axes 256 to accommodate the staggered ground contacts 232. While the ground contacts 232 are slightly staggered along the row axis 256, the ground contacts 232 are considered to be part of the respective ground row 250 as such ground contacts 232 are in close proximity to the row axis 256 and associated with the ground row 250.

Adjacent signal pairs 240 of the signal contacts 230 along the column axes 258 alternate between column pairs 260 and cross pairs 262. Similarly, adjacent signal pairs 240 of signal contacts 230 along the row axes 256 alternate between column pairs 260 and cross pairs 262. Each column pair 260 is surrounded on all populated sides by cross pairs 262, and similarly, each cross pair 262 is surrounded on all populated sides by column pairs 260.

The signal contacts 230 within each pair 240 are separated by a gap 270. The gap 270 between the signal contacts 230 of each column pair 260 is in-column along the corresponding column axis 258 with the signal contacts 230 of the column pair 260. The gap 270 between the signal contacts 230 of each cross pair 262 is aligned with the column axis 258 of the corresponding column 254. Similarly, the gap 270 between the signal contacts 230 of each cross pair 262 is in-row along the corresponding row axis 256 with the signal contacts 230 of the cross pair 262. The gap 270 between the signal contacts 230 of each column pair 260 is aligned with the row axis 256 of the corresponding signal row 252.

The ground contacts 232 are arranged between adjacent pairs 240 of signal contacts 230 in the corresponding columns 254. The ground contacts 232 thus provide electrical shielding between the pairs 240 of signal contacts 230 in the column 254. In an exemplary embodiment, the ground contacts 232 are arranged along the column axes 258. The ground contacts 232 are arranged in-column between each alternating cross pair 262 and column pair 260 in the column 254. In an exemplary embodiment, each column pair 260 is flanked on opposite sides, in the column 254, by ground contacts 232.

The broad sides 280, 282 of the signal contacts 230 of the cross pair 262 are parallel to the corresponding column axis 258. The broad sides 280, 282 of the signal contacts 230 of the column pair 260 are perpendicular to the column axis 258 and/or parallel to the row axis 256. Each of the broad sides 280, 282 of the signal contacts 230 of the column pair 260 is equidistant from the edge sides 284 or 286 of the signal contacts 230 of the nearest cross pair 262 in the same column 254 to such column pair 260. Each of the broad sides 280, 282 of the signal contacts 230 of the cross pair 262 is equidistant from the edge sides 284 or 286 of the signal contacts 230 of the nearest column pair 260 in the adjacent column 254 to such cross pair 262. Such a symmetric arrangement of the column pairs 260 and cross pairs 262 provides signal or noise cancelling for the differential pairs of signal contacts 230 for signal integrity, such as between pairs 240 in different columns 254. The noise cancelling effect mitigates the need for shielding between the columns 254, such as using ground contacts 232, eliminating the need for columns of ground contacts 232 between the columns of signal contacts 230. The signal contacts 230 may thus be more tightly or densely populated within the footprint of the rear housing 212.

The lossy spacers 202 are interspersed through the receptacle connector 102, such as in each of the ground rows 250. In an exemplary embodiment, the lossy spacers 202 do not span across any of the signal rows 252. The lossy spacers 202 are separate and discrete from each other. The low loss dielectric material of the rear housing 212 is provided between each of the lossy spacers 202. For example, each of the lossy spacers 202 are separated by gaps 320 and the low loss material of the rear housing 212 at least partially fills the gaps 320. Optionally, air or other dielectric material may be provided in the gaps 320.

The gaps 320 are provided between lossy spacers 202 in the same ground row 250, such as between the ends 308, 310 of adjacent lossy spacers 202. The gaps 320 are provided between lossy spacers 202 in the same column 254, such as between the sides 304, 306 of adjacent lossy spacers 202, with corresponding pairs of signal contacts 230 being positioned in the gaps 320 between the sides 304, 306 of the flanking lossy spacers 202. The open sides 304 of the lossy spacers 202 may face the signal contacts 230 or the closed sides 306 of the lossy spacers 202 may face the signal contacts 230. For example, in the illustrated embodiment, the open sides 304 face the cross pairs 262 of signal contacts 230 while the closed sides 306 face the column pairs 260 of signal contacts 230. Other arrangements are possible in alternative embodiments.

In the illustrated embodiment shown in FIG. 5, the lossy spacers 202 have alternating orientations in the rear housing 212. For example, within each ground row 250, successive lossy spacers 202 are oriented 180° relative to each other. For example, the first sides 304 of adjacent lossy spacers 202 within a ground row 250 are oriented in respective opposite directions and face signal contacts 230 in different signal rows 252.

The ground contacts 232 are received in corresponding grooves 312. Optionally, the ground contacts 232 may engage one or more of the groove walls 314. For example, the broad sides 280, 282 and/or the edge sides 284, 286 may engage corresponding groove walls 314. In an exemplary embodiment, the rear housing 212 includes alignment tabs 330 extending into the grooves 312. The alignment tabs 330 may engage the ground contacts 232 to position the ground contacts 232 in the corresponding grooves 312 of the lossy spacers 202. The alignment tabs 330 may engage the broad sides 280 or 282 and force the other broad side 280 or 282 into the groove wall 314 opposite the alignment tabs 330.

Optionally, the lossy spacers 202 are received in the pockets 229 at the inner end 226 of the rear housing 212 such that the fronts 300 of the lossy spacers 202 are coplanar with the inner end 226 at the seam 227. In other embodiments, the lossy spacers 202 may span across the seam 227, such as with the fronts 300 received in the front housing 210 (shown in phantom in FIG. 4) and the rears 302 received in the rear housing 212. In other various embodiments, the lossy spacers 202 may be received only in the front housing 210 rather than in the rear housing 212. In other embodiments, rather than being provided at the seam 227, the lossy spacers 202 may be provided remote from the seam 227, such as at or near the mounting end 224 and/or at a middle location between the inner end 226 and the mounting end 224 (the end 224 may be an outer end and not necessarily define the mounting end in various embodiments, such as when the housing 212 is not a rear housing but rather is a middle housing). In the illustrated embodiments, the lossy spacers 202 extend along only a portion of the ground contacts 232. Alternatively, the lossy spacers 202 may extend substantially the entire axial length of the ground contacts 232. For example, as shown in phantom in FIG. 4, the lossy spacers 202 may extend from at or near the inner end 226 of the rear housing 212 to at or near the mounting end 224. In other embodiments, the lossy spacers 202 may be provided at multiple axially spaced apart locations along the ground contacts 232, such lossy spacers 202 having low loss housing material therebetween and/or air therebetween. The lossy spacers 202 may be provided at approximately regular intervals along the lengths of the ground contacts 232. Providing the lossy material at different locations along the ground contacts 232 or over a considerable length of the ground contacts 232 may enhance the absorbing properties of the receptacle connector 102 to improve performance of the receptacle connector 102. In other various embodiments, rather than having the lossy spacers 202 molded in the pockets 229 or inserted into the pockets 229 prior to the ground contacts 232 being loaded into the contact cavities 228, the lossy spacers 202 may be overmolded over the corresponding ground contacts 232 and loaded into the contact cavities 228 with the ground contacts 232.

The above described embodiments provide an electrical connector, such as a mezzanine connector, that provides lossy spacers along portions of the ground contacts. The lossy material absorbs at least some electrical resonance that propagates along the current path defined by the signal contacts and/or the ground contacts to provide lossy conductivity and/or magnetic lossiness. The lossy material provides electrical loss in a certain, targeted frequency range. Electrical performance of the electrical connector is enhanced by the inclusion of the lossy material. For example, at various data rates, including high data rates, return loss is inhibited by the lossy material. For example, the return loss of the small pitch, high speed data of the signal contacts due to the close proximity of signal and ground contacts is reduced by the lossy material. For example, energy from the ground contacts on either side of the signal pair reflected in the space between the ground contacts is absorbed, and thus connector performance and throughput is enhanced.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing stack comprising a first housing and a second housing stacked together with the first housing, the housing stack defining a mating end configured for mating with a mating connector and a mounting end configured for mounting to a circuit board, the mounting end being opposite the mating end, the second housing disposed rearward of the first housing, the housing stack defining signal contact cavities and ground contact cavities that extend continuously through the first housing and the second housing between the mating end and the mounting end, at least one of the first housing and the second housing having pockets around the ground contact cavities;

lossy spacers disposed in corresponding pockets, the lossy spacers each having a groove aligned with the corresponding ground contact cavity;

signal contacts disposed in corresponding signal contact cavities of the housing stack and being provided at or near the mating and mounting ends for electrical connection to the mating connector and the circuit board, respectively; and ground contacts disposed in corresponding ground contact cavities of the housing stack and being provided at or near the mating and mounting ends for electrical connection to the mating connector and the circuit board, respectively, the ground contacts being disposed in the grooves of the corresponding lossy spacers such that the ground contacts are coupled to the corresponding lossy spacers.

2. The electrical connector of claim 1, wherein the lossy spacers are separated from each other by gaps.

3. The electrical connector of claim 1, wherein the lossy spacers are separated from each other with low loss material of the corresponding first housing or the second housing between each of the lossy spacers.

4. The electrical connector of claim 1, wherein the lossy spacers are molded in situ in the pockets.

5. The electrical connector of claim 1, wherein the lossy spacers are separate and discrete pieces inserted into the pockets.

6. The electrical connector of claim 1, wherein the lossy spacers are positioned in the pockets prior to assembly of the first housing and the second housing in the housing stack and prior to loading the ground contacts into the ground contact cavities.

7. The electrical connector of claim 1, wherein the lossy spacers are overmolded over the corresponding ground contacts and loaded into the ground contact cavities with the ground contacts.

8. The electrical connector of claim 1, wherein the first and second housings include inner ends each other at a seam, the pockets being provided at the seam.

9. The electrical connector of claim 1, wherein the pockets are provided at or near the mounting end.

10. The electrical connector of claim 1, wherein the pockets and corresponding lossy spacers extend substantially entirely through the corresponding first or second housing.

11. The electrical connector of claim 1, further comprising a third housing in the housing stack, wherein at least one of the first housing, the second housing and the third housing includes pockets receiving corresponding lossy spacers.

12. The electrical connector of claim 1, wherein the grooves are open sided.

13. The electrical connector of claim 1, wherein each lossy spacer includes a channel defining an air pocket in the lossy spacer open to the corresponding ground contact.

14. The electrical connector of claim 1, wherein the corresponding first or second housing includes alignment tabs extending into the grooves, the alignment tabs engaging the ground contacts to position the ground contacts in the grooves of the lossy spacers.

15. The electrical connector of claim 1, wherein the signal contacts are arranged in signal rows along corresponding row axes and the ground contact are arranged in ground rows along corresponding row axes, the lossy spacers being aligned with each of the ground rows.

16. The electrical connector of claim 1, wherein the lossy spacers are each manufactured from a lossy material that absorbs at least some electrical resonance propagating through the electrical connector between the mating end and the mounting end, the lossy material having conductive particles in a dielectric binder material.

17. An electrical connector comprising:

a housing stack comprising a first housing and a second housing stacked together with the first housing, the housing stack defining a mating end configured for mating with a mating connector and a mounting end configured for mounting to a circuit board, the mounting end being opposite the mating end, the second housing disposed rearward of the first housing, the housing stack defining signal contact cavities and ground contact cavities that extend axially through the first housing and the second housing between the mating end and the mounting end, at least one of the first housing and the second housing having pockets around the ground contact cavities;

lossy spacers disposed in corresponding pockets, the lossy spacers each having a groove aligned with the corresponding ground contact cavity, the lossy spacers being separated from each other by gaps; and signal contacts and ground contacts disposed in corresponding signal and ground contact cavities of the housing stack and being provided at or near the mating and mounting ends for electrical connection to the mating connector and the circuit board, respectively, the ground contacts being disposed in the grooves of the corresponding lossy spacers such that the ground contacts are coupled to the corresponding lossy spacers, the signal contacts being arranged in signal rows along signal row axes and the ground contacts being arranged in ground rows along ground row axes.

18. The electrical connector of claim 17, wherein the lossy spacers are separated from each other with low loss material of the corresponding first housing or the second housing in the gaps between each of the lossy spacers.

19. The electrical connector of claim 17, wherein the lossy spacers are molded in situ in the pockets.

20. An electrical connector comprising:

a housing stack comprising a first housing and a second housing stacked together with the first housing, the housing stack defining a mating end configured for mating with a mating connector and a mounting end configured for mounting to a circuit board, the mounting end being opposite the mating end, the second housing disposed rearward of the first housing, the housing stack having opposite first and second sides and opposite first and second ends extending between the mating and mounting ends, the housing stack defining signal contact cavities and ground contact cavities that extend axially through the first housing and the second housing between the mating end and the mounting end, at least one of the first housing and the second housing having pockets at the seam around the ground contact cavities;

lossy spacers disposed in corresponding pockets, each lossy spacer having a front and a rear rearward of the front, each lossy spacer having opposite first and second sides and opposite first and second ends, each lossy spacer having a groove open at the first side, the lossy spacers being arranged in an array in rows and columns, the ends of the lossy spacers in the rows being separated by gaps, the sides of the lossy spacers in the columns being separated by gaps;

signal contacts disposed in corresponding contact cavities of the housing stack and being provided at or near the mating and mounting ends for electrical connection to the mating connector and circuit board, respectively, the signal contacts being aligned in-column with the columns of lossy spacers and being positioned in the gaps therebetween such that the signal contacts do not directly engage the lossy spacer; and ground contacts disposed in corresponding ground contact cavities of the housing stack and being provided at or near the mating and mounting ends for electrical connection to the mating connector and the circuit board, respectively, the ground contacts being disposed in the grooves of the corresponding lossy spacers such that the ground contacts are coupled to the corresponding lossy spacers.

* * * * *